US008490521B2

(12) United States Patent
Huang

(10) Patent No.: US 8,490,521 B2
(45) Date of Patent: Jul. 23, 2013

(54) RATCHET TOOL

(76) Inventor: Chin-Tan Huang, Taichung County (TW)

( * ) Notice: Subject to any disclaimer, the term of this patent is extended or adjusted under 35 U.S.C. 154(b) by 316 days.

(21) Appl. No.: 12/873,859

(22) Filed: Sep. 1, 2010

(65) Prior Publication Data

US 2011/0259157 A1 Oct. 27, 2011

(51) Int. Cl.
*B25B 13/46* (2006.01)

(52) U.S. Cl.
USPC ..... 81/63.1; 192/43.2

(58) Field of Classification Search
USPC ..... 81/60–63.2; 192/43.1, 43.2
See application file for complete search history.

(56) References Cited

U.S. PATENT DOCUMENTS 3,290,969 A * 12/1966 Bergquist et al. ..... 81/63.1
3,621,739 A * 11/1971 Seablom ..... 81/63.1
6,053,077 A * 4/2000 Huang ..... 81/63.1
6,644,147 B1 * 11/2003 Huang ..... 81/62
6,817,458 B1 * 11/2004 Gauthier ..... 81/62
7,380,482 B1 * 6/2008 Chan ..... 81/63.1

* cited by examiner

*Primary Examiner* — Hadi Shakeri

(74) *Attorney, Agent, or Firm* — Greenberg Traurig, LLP

(57) ABSTRACT

A ratchet tool includes a tool head provided with a plurality of ratchet teeth on an inner peripheral surface, a drive body having an outer surrounding surface confronting the ratchet teeth, and a guiding slot for receiving first and second pawls and a biasing member to permit the pawls to be displaced between extending and retracted positions, and an actuator twistable relative to the head and having two inner boundary contours to define two recessed regions to accommodate displaceable engagements of keys of the pawls with the inner boundary contours. The pawl end is configured to extend along an entire axial length of the drive body so as to be fully engaged with the ratchet teeth in the engaging position, thereby permitting transmission of a relatively large torque during rotation of the tool head.

8 Claims, 12 Drawing Sheets

RATCHET TOOL

CROSS-REFERENCE TO RELATED APPLICATION

This application claims priority of Taiwanese Patent Application No. 099112871, filed on Apr. 23, 2010, the disclosure of which is herein incorporated by reference.

BACKGROUND OF THE INVENTION

1. Field of the Invention

This invention relates to a ratchet tool, more particularly to a direction-convertible ratchet tool.

2. Description of the Related Art

A conventional ratchet hand tool, such as that disclosed in each of Taiwanese Patent Nos. 371612, 364578, 361409, 361407, and 361406, generally includes a main body, a coupling member disposed at an end of the main body and adapted to couple with a tool bit, and a pawl shiftable to engage or disengage from the coupling member to transmit a torque from the main body to the coupling member in a clockwise or counterclockwise direction or in both directions. However, since only a single pawl is disposed to engage the coupling member, the driving surface is relatively small, so that wearing of the ratchet teeth formed on the main body and slippage of the pawl may occur.

In order to overcome the drawbacks associated with the aforementioned prior art, the applicant has disclosed in U.S. Pat. Nos. 6,047,802 and 7,434,493B2, a ratchet driving mechanism which has a plurality of pawls to form at least two connection points between the main body and the coupling member so as to accommodate a large torque. However, since each pawl has an end surface which is disposed to engage both the ratchet tooth and an actuating portion of an adjusting ring, the connection area between the ratchet teeth and the pawl is decreased.

SUMMARY OF THE INVENTION

An object of the present invention is to provide a ratchet tool which can reliably accommodate a large torque.

According to this invention, the ratchet tool includes a tool head having an inner peripheral surface which surrounds a rotating axis, which defines an accommodation space, and which is provided with a plurality of ratchet teeth. A drive body is rotatably received in the accommodation space about the rotating axis, and has an outer surrounding surface surrounding the rotating axis to confront the ratchet teeth, and a body major wall surface having a guiding slot which extends through the outer surrounding surface to form two ports thereat. Each of first and second pawls includes a guided body which is fitted in and which is movable relative to the guiding slot, and which extends toward the ratchet teeth to terminate at a pawl end such that the guided body is displaceable between an extending position, where the pawl end extends through a respective one of the ports and is engaged with one of the ratchet teeth, and a retracted position, where the pawl end is retracted in the guiding slot and is disengaged from one of the ratchet teeth, and a key extending from the guided body in a direction of the rotating axis and outwardly of the body major wall surface. A biasing member is disposed to bias the guided bodies toward the extending position. An actuator is disposed to be twistable relative to the tool head about the rotating axis, and has two inner boundary contours which define two recessed regions to respectively accommodate displaceable engagements of the keys with the inner boundary contours, and which are configured such that, when the actuator is twisted by a predetermined degree of angle, each of the keys is displaced between a proximate position and a distal position relative to the rotating axis, thereby bringing the guided body to move between the extending and retracted positions.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
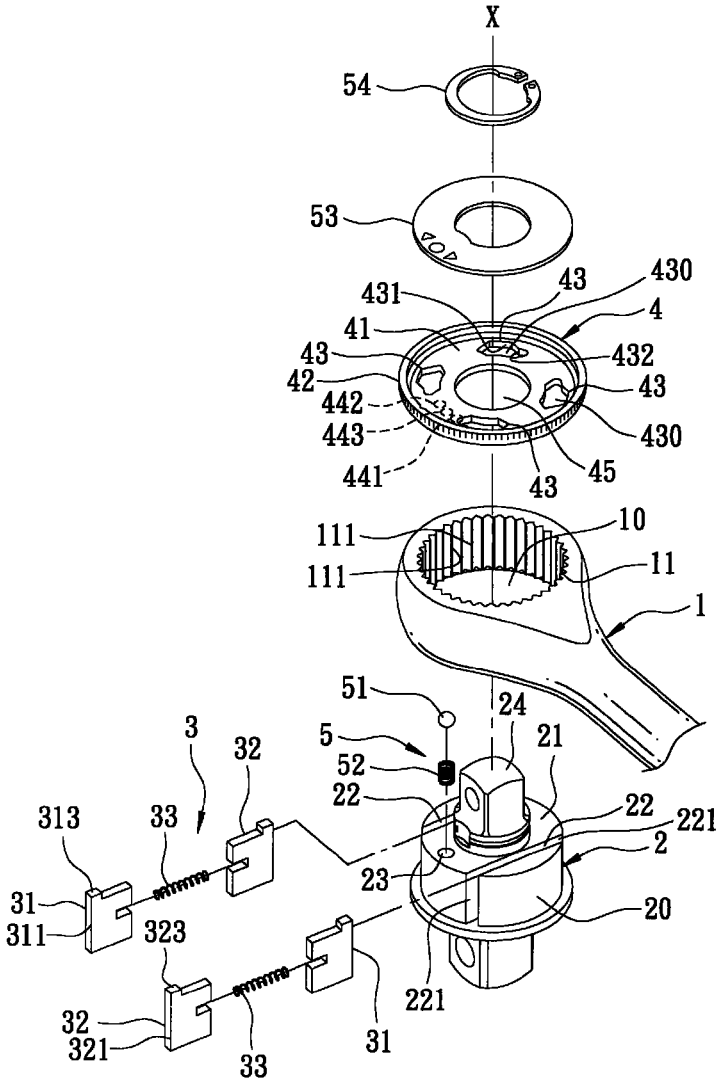
FIG. 1 is an exploded perspective view of the first preferred embodiment of a ratchet tool according to this invention.

Before the present invention is described in greater detail, it should be noted that same reference numerals have been used to denote like elements throughout the specification.

Figure 2:
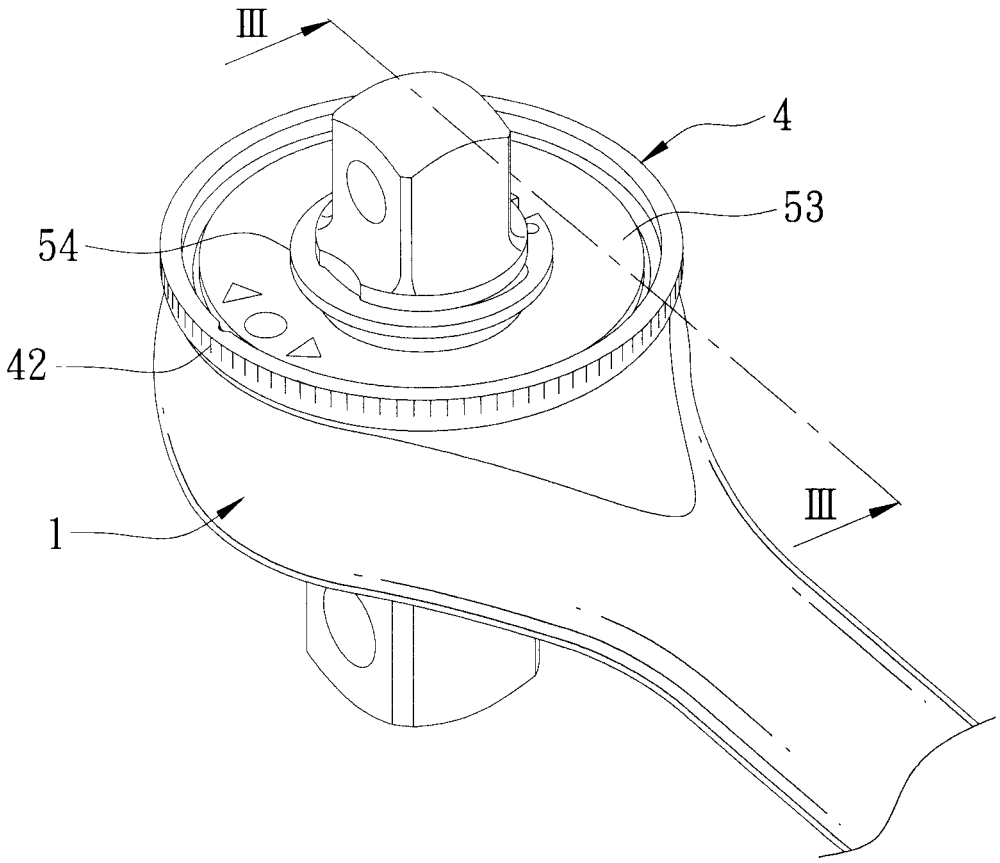
FIG. 2 is a perspective view of the first preferred embodiment.
Figure 3:
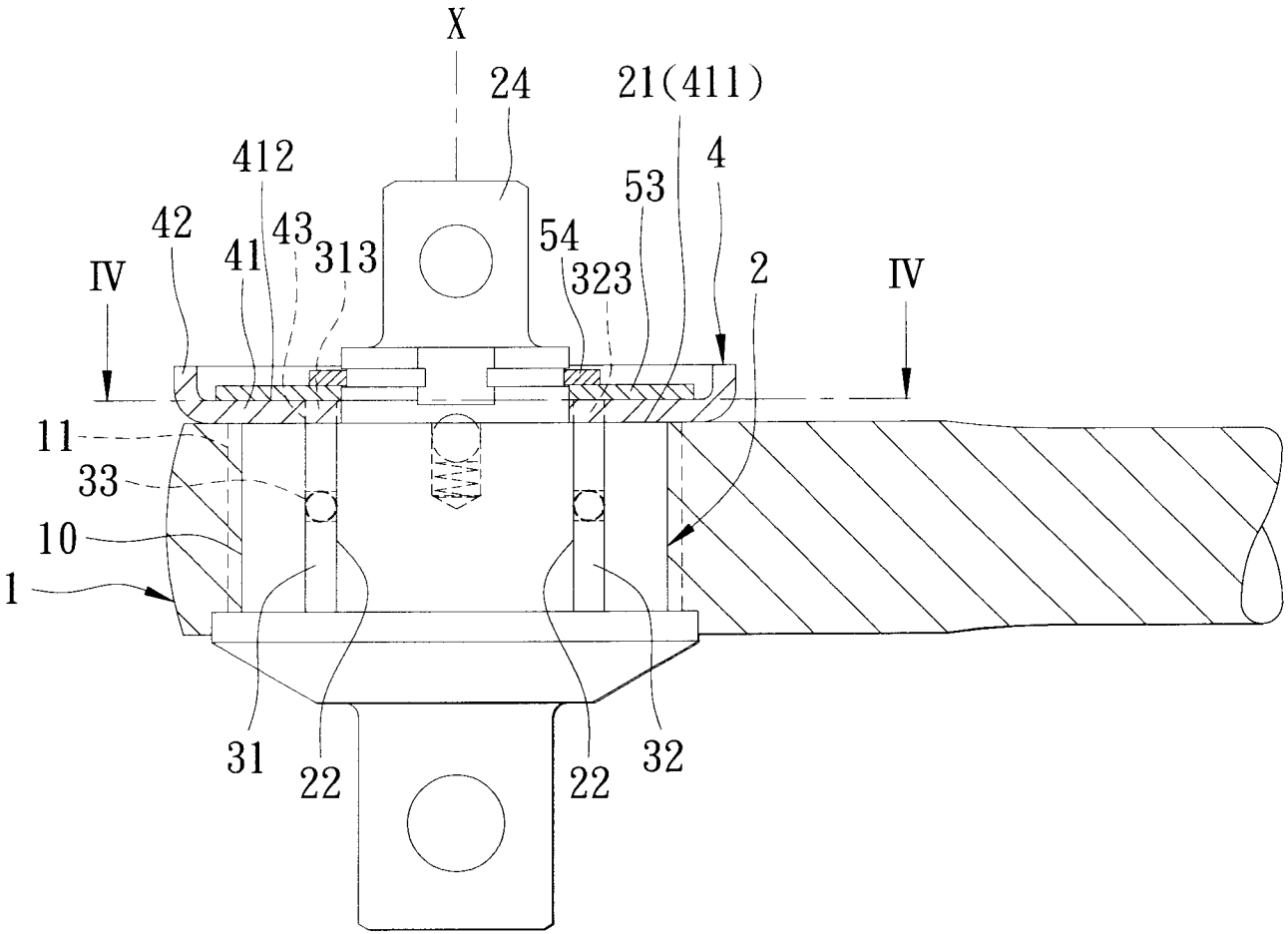
FIG. 3 is a sectional view taken along line of FIG. 2.

Referring to FIGS. 1 to 3, the preferred embodiment of a ratchet tool according to the present invention is shown to comprise a tool head 1, a drive body 2, a ratchet-and-pawl assembly 3, an actuator 4, and a releasably retaining unit 5.

The tool head 1 has an inner peripheral surface 11 which surrounds a rotating axis (X), and which defines an accommodation space 10. A plurality of ratchet teeth 111 are disposed on the inner peripheral surface 11. In this embodiment, the ratchet teeth 111 are integrally formed with the inner peripheral surface 11.

The drive body 2 is rotatably received in the accommodation space 10 about the rotating axis (X), and has an outer surrounding surface 20 which surrounds the rotating axis (X), and which confronts the ratchet teeth 111, and a body major wall surface 21 facing along the rotating axis (X). The body major wall surface 21 has two guiding slots 22 which are disposed in symmetry to each other relative to the rotating axis (X), and each of which extends through the outer surrounding surface 20 to form two ports 221 thereat, and a receiving hole 23 extending in a direction of the rotating axis (X). The drive body 2 further includes a mounting post 24 extending from the body major wall surface 21 along the rotating axis (X).

The ratchet-and-pawl assembly 3 includes first and second pawls 31, 32 and a first biasing member 33 disposed in one of the guiding slots 22, and third and fourth pawls 31, 32 and a second biasing member 33 disposed in the other one of the guiding slots 22. Each of the first, second, third and fourth pawls 31, 32 includes a guided body 310, 320 and a key 313, 323. The guided body 310, 320 is fitted in and is movable relative to the respective guiding slot 22, and extends toward the ratchet teeth 111 to terminate at a pawl end 311, 321 such that the guided body 310, 320 is displaceable between an extending position, where the pawl end 311, 321 extends through the respectively port 221 and is engaged with one ratchet tooth 111, and a retracted position, where the pawl end 311, 321 is retracted in the respective guiding slot 22 and is disengaged from the ratchet tooth 111. The key 313, 323 extends from the guided body 310, 320 in the direction of the rotating axis (X) and outwardly of the body major wall surface 21. The first and second biasing members 33 are disposed between the first and second pawls 31, 32 and between the third and fourth pawls 31, 32, respectively, so as to bias the guided bodies 310, 320 of each pawl 31, 32 toward the extending position.

The actuator 4 is disposed on the body major wall surface 21 to be twistable relative to the tool head 1 about the rotating axis (X). The actuator 4 includes an actuator major wall 41 having an inner major wall surface 411 which confronts the accommodation space 10, and an outer major wall surface 412 opposite to the inner major wall surface 411, and a rim 42 extending from a marginal area of the outer major wall surface 412 in the direction of the rotating axis (X). The inner major wall surface 411 has a central opening 45 to permit the actuator 4 to be sleeved on the mounting post 24. In this embodiment, the inner major wall surface 411 has four inner boundary contours 43 which define four recessed regions 430 extending through the outer major wall surface 412. Each of the recessed regions 430 has proximate and distal segments 432,431 angularly displaced from each other about the rotating axis (X).

The releasably retaining unit 5 includes three positioning recesses 441, 442, 443 formed in the inner major wall surface 411 and angularly displaced from one another, and a spring-loaded ball 51 received in the receiving hole 23 and urged to engage a selected one of the positioning recesses 441, 442, 443. A cap 53 having a central mounting hole 531 is disposed on the outer major wall surface 412 of the actuator 4 and is retained thereon by a C-shaped hoop 54.

Figure 4:
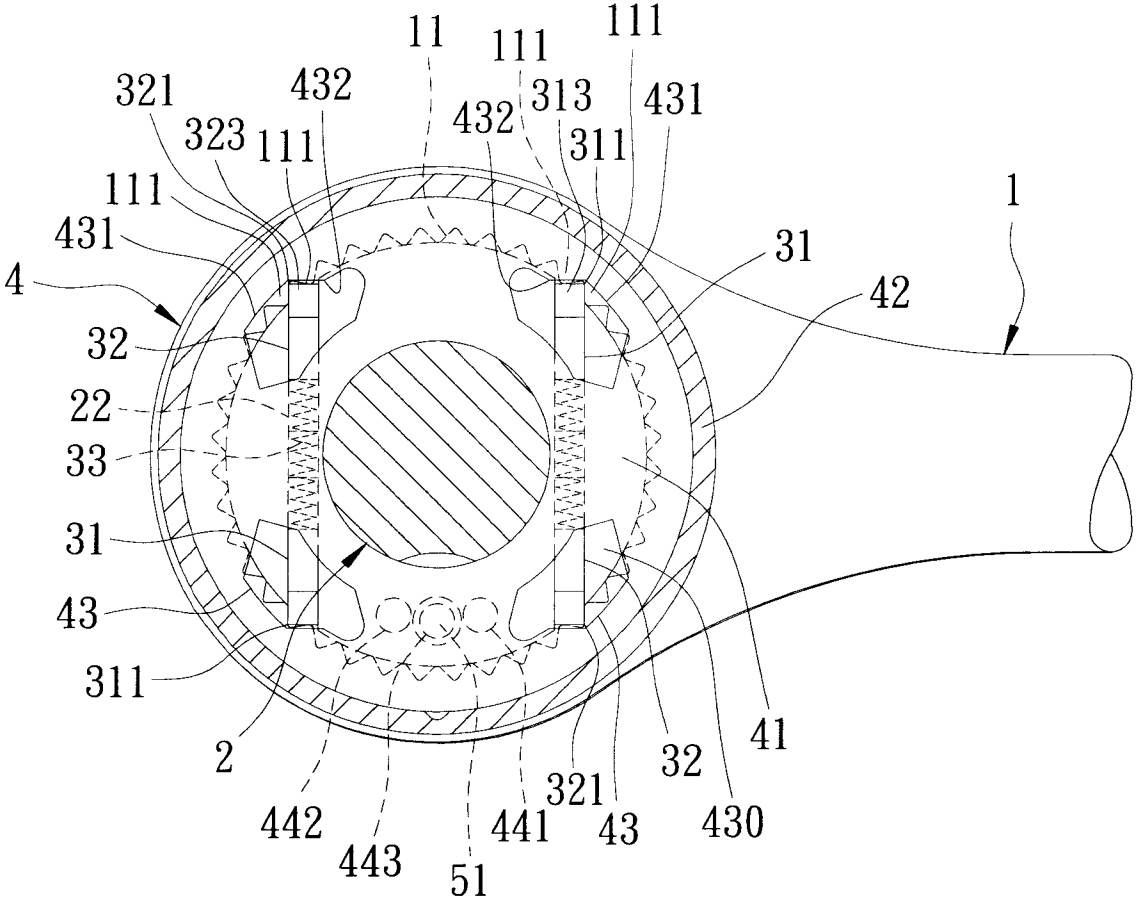
FIG. 4 is a sectional view taken along line IV-IV of FIG. 3 when an actuator is in a midway position.

Referring to FIGS. 3 and 4, when the actuator 4 is twisted in a midway position where the ball 51 is engaged in the positioning recess 443, the keys 313, 323 are simultaneously displaced to the distal segments 431 in a distal position to move the guided bodies 310, 320 to the extending position so as to prevent rotation of the drive body 2 relative to the tool head 1. At this stage, since the pawl ends 311, 321 are configured to extend along an entire axial length of the drive body 2 so as to be fully engaged with the ratchet teeth 111, the rather wide area of engagement with the ratchet tooth 111 vests each pawl 31, 32 with high durability to bear a relatively large torque upon rotation of the tool head 1.

Figure 5:
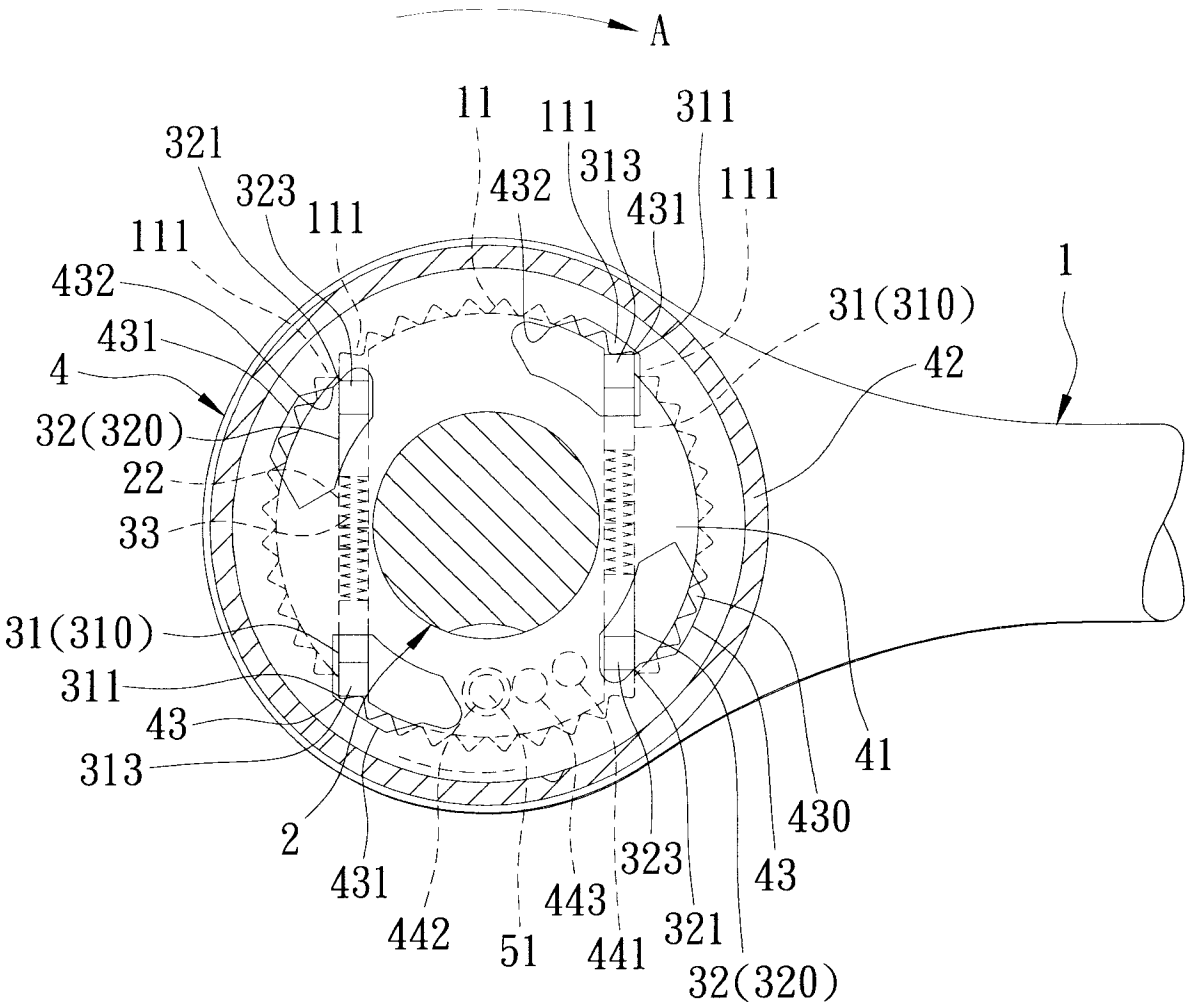
FIG. 5 is a sectional view similar to FIG. 4 when the actuator is in a forward-direction position.
Figure 6:
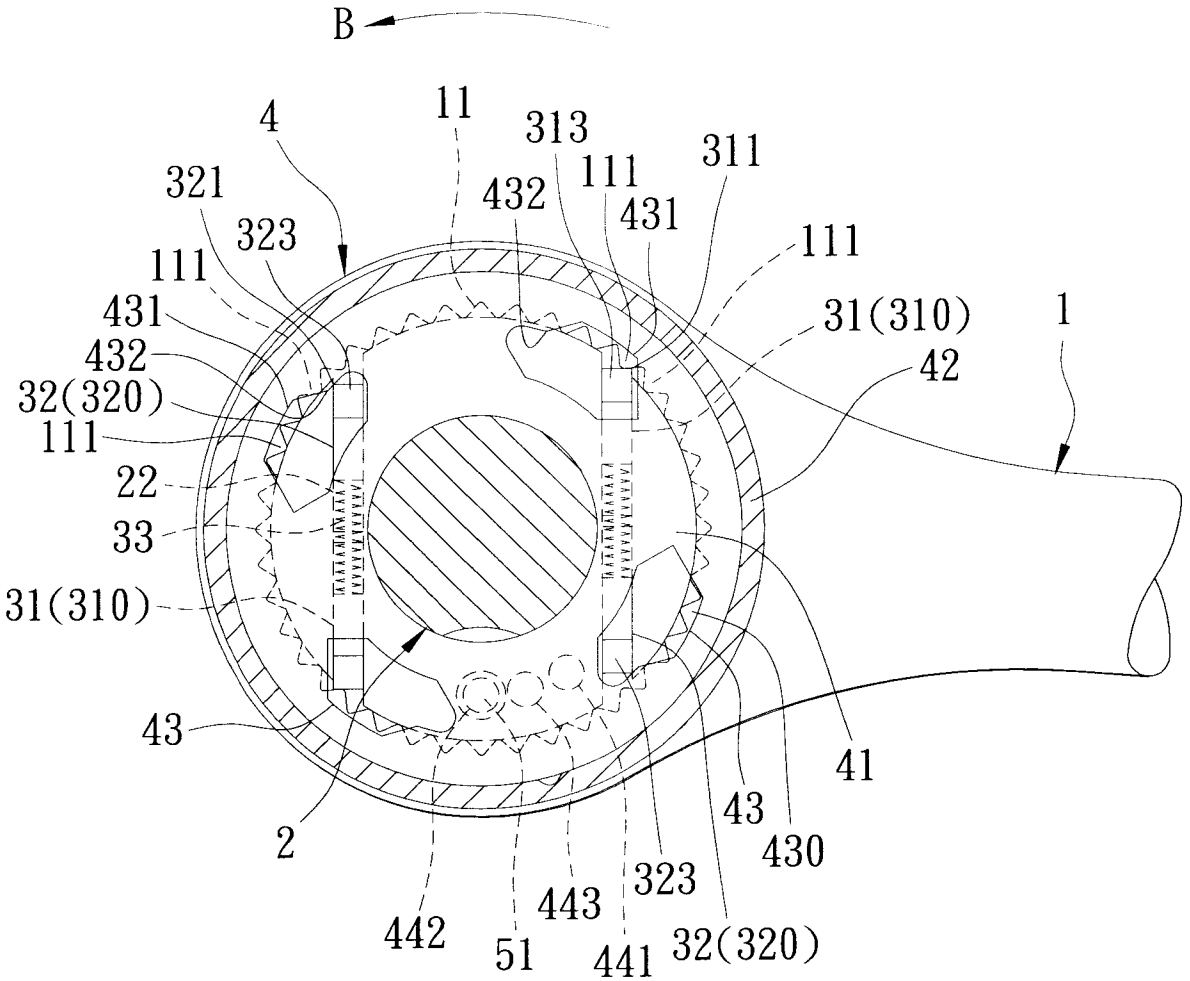
FIG. 6 is a sectional view similar to FIG. 5 when a tool head is rotated in a clockwise direction.

Referring to FIGS. 5 and 6, when the actuator 4 is twisted manually against the biasing force of the spring 52 to displace the actuator 4 to a forward-direction position where the ball 51 is engaged in the positioning recess 442, the keys 313 of the first and third pawls 31 are still disposed in the distal segments 431 to permit the guided bodies 310 of the first pawls 31 to remain at the extending position, and the keys 323 of the second and fourth pawls 32 are displaced to the proximate segments 432 in a proximate position to move the guided bodies 320 of the pawls 32 to the retracted position. At this stage, when the tool head 1 is rotated in a clockwise direction (A), by means of engagement of the pawl ends 311 of the pawls 31 with the ratchet teeth 111, the drive body 2 is rotated with the tool head 1 in the clockwise direction (A). As shown in FIG. 6, when the tool head 1 is rotated in a counterclockwise direction (B), due to disengagement of the pawls 32 from the ratchet teeth 111 and by the rotation of the ratchet teeth 111 in the counterclockwise direction (B), the pawl ends 311 of the pawls 31 are pressed by the ratchet teeth 111 to be retracted into the guiding slots 22 so as to allow rotation of the tool head 1 relative to the drive body 2.

Figure 7:
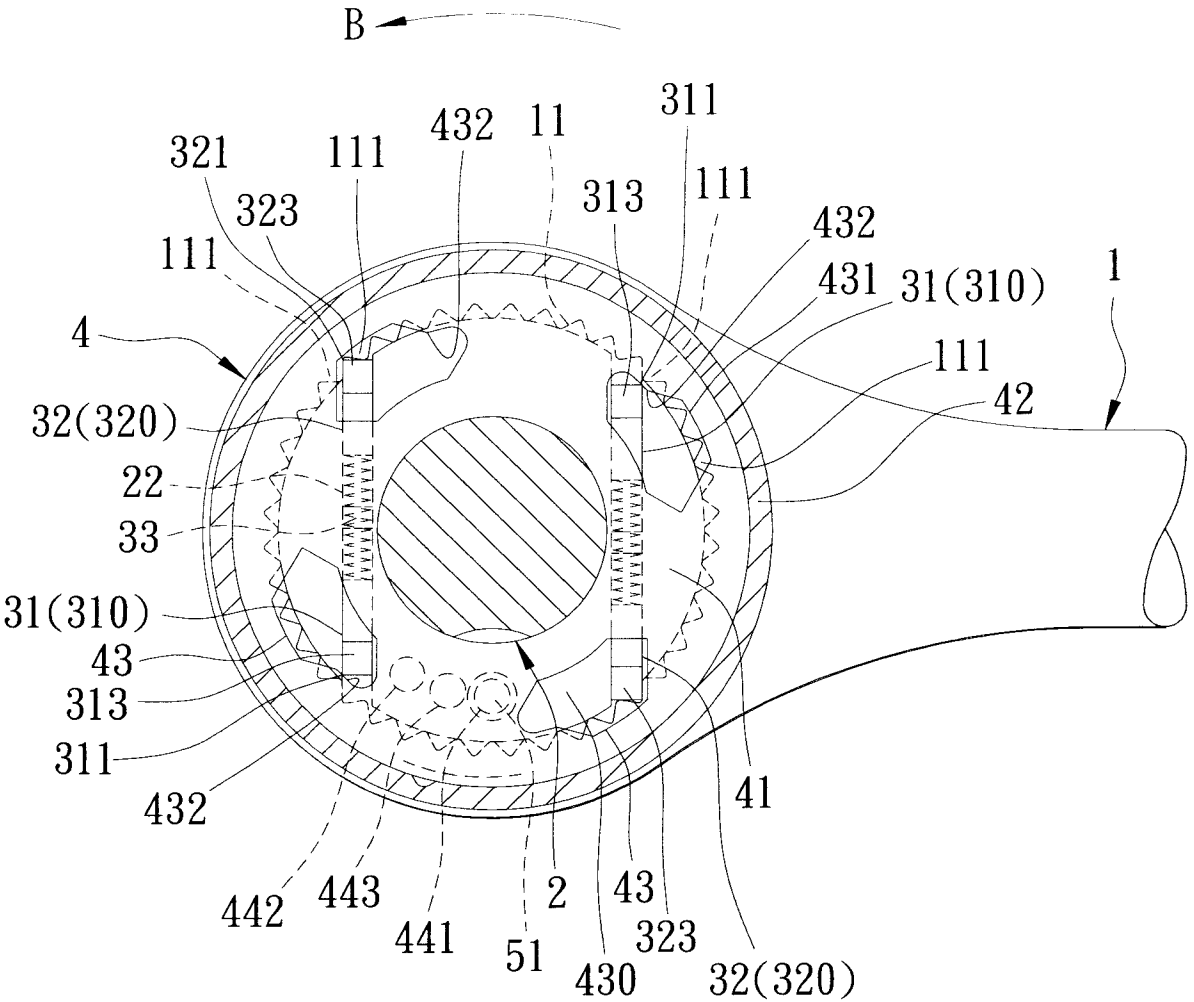
FIG. 7 is a sectional view similar to FIG. 4 when the actuator is in a backward-direction position.
Figure 8:
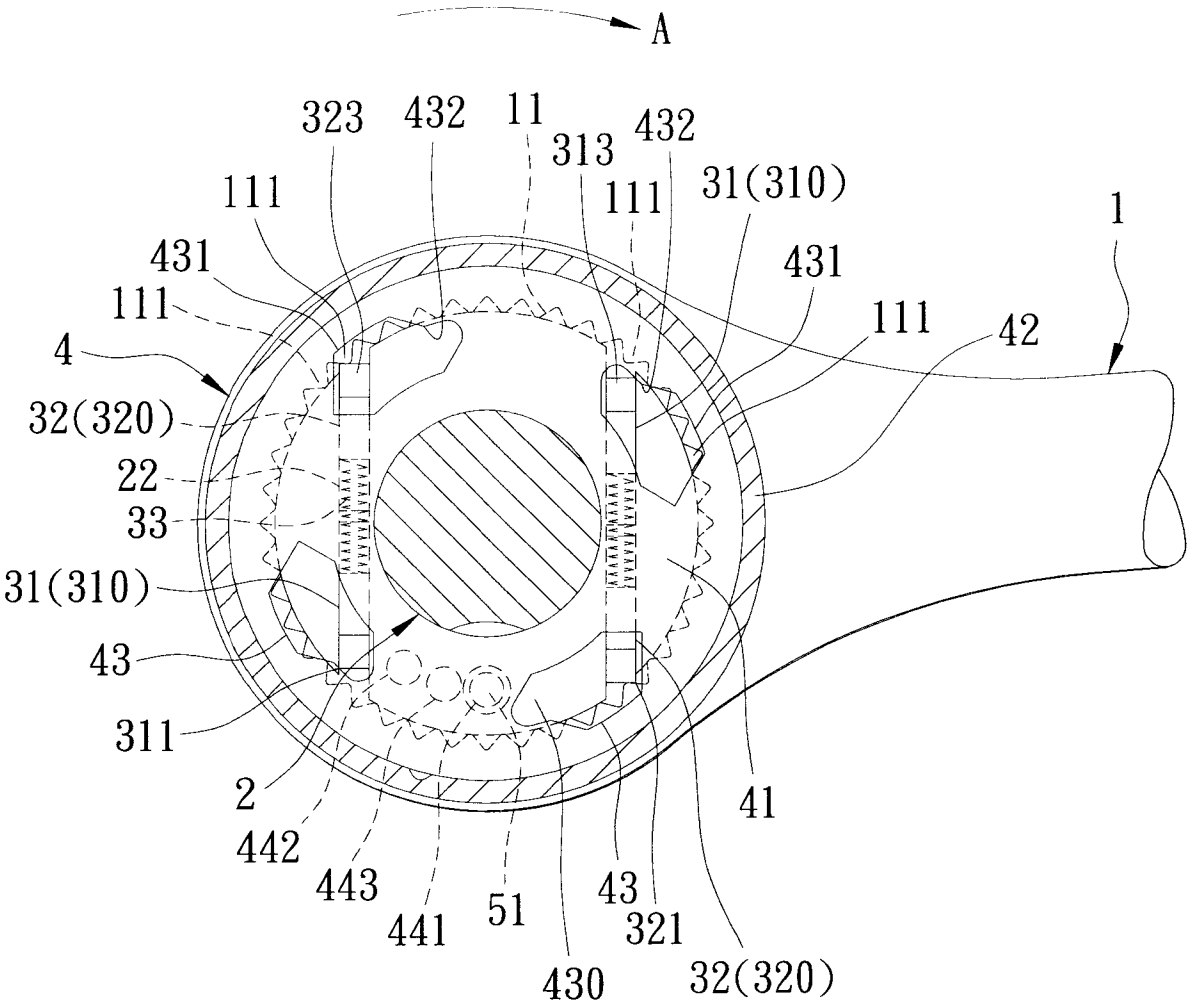
FIG. 8 is a sectional view similar to FIG. 7 when the tool head is rotated in a counterclockwise direction.

Referring to FIGS. 7 and 8, when the actuator 4 is twisted to a backward-direction position where the ball 51 is engaged in the positioning recess 441, the keys 313 of the first and third pawls 31 are displaced to the proximate segments 432 in the proximate position to move the guided bodies 310 of the pawls 31 to the retracted position, and the keys 323 of the second and fourth pawls 32 are displaced to the distal segments 431 in the distal position to permit the guided bodies 320 to the extending position. At this stage, when the tool head 1 is rotated in the counterclockwise direction (B), by means of engagement of the pawl ends 321 of the pawls 32 with the ratchet teeth 111, the drive body 2 is rotated with the tool head 1 in the counterclockwise direction (B). As shown in FIG. 8, when the tool head 1 is rotated in the clockwise direction (A), due to disengagement of the pawls 31 from the ratchet teeth 111 and by the rotation of the ratchet teeth 111 in the clockwise direction (A), the pawl ends 311 of the pawls 31 are pressed by the ratchet teeth 111 to be retracted into the guiding slots 22 so as to allow rotation of the tool head 1 relative to the drive body 2.

Figure 9:
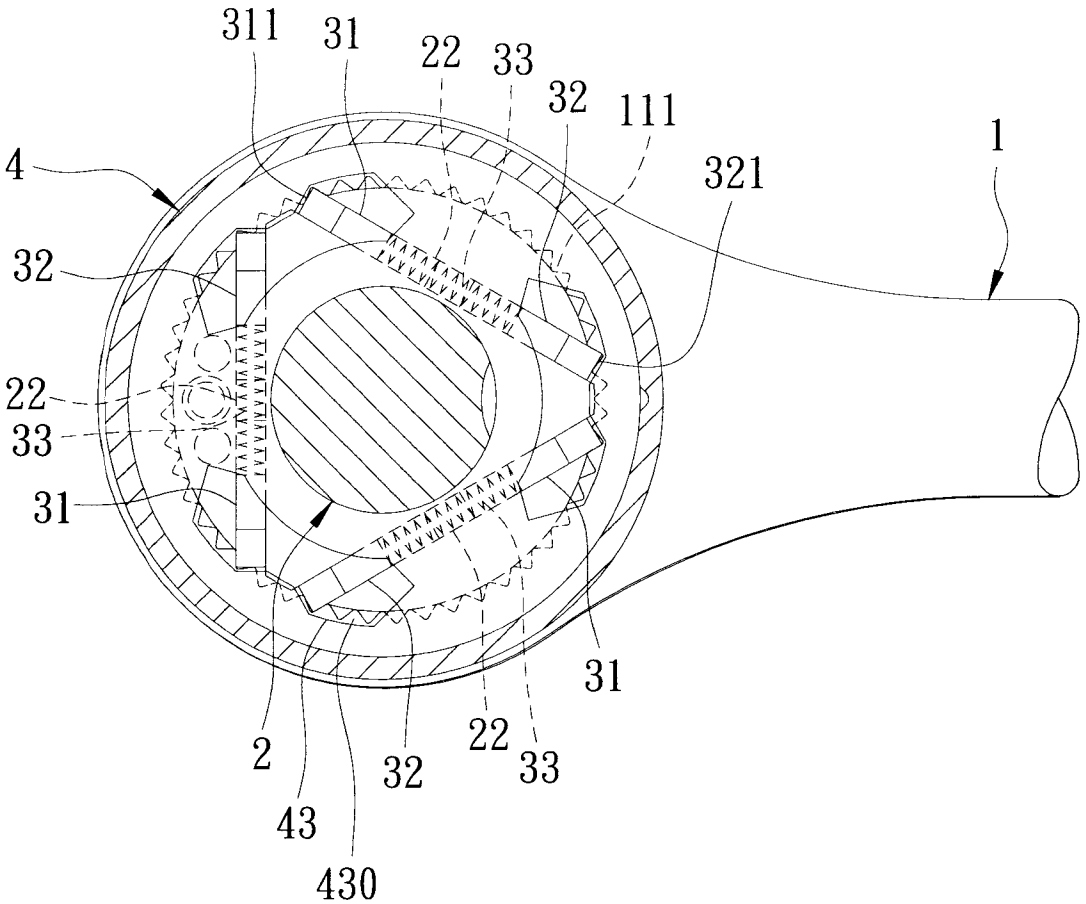
FIG. 9 is a sectional view of the second preferred embodiment of a ratchet tool according to this invention.

Referring to FIG. 9, the second preferred embodiment of a ratchet tool according to this invention is similar to the previous embodiment in construction, except that the drive body 2 has three guiding slots 22 arranged around the rotating axis (X), and the ratchet-and-pawl assembly 3 further includes fifth and sixth pawls 31, 32 and a third biasing member 33 disposed in the third guiding slot 22 and having the same configuration as the first and second pawls 31, 32 and the first biasing member 33. Thus, at least three pawl ends 311, 321 are engaged with the ratchet teeth 111 during rotation of the tool head 1 when the actuator 4 is in any one of the midway, forward-direction and backward-direction positions, thereby reinforcing the structural strength of the ratchet tool and permitting transmission of even much larger torque.

Figure 10:
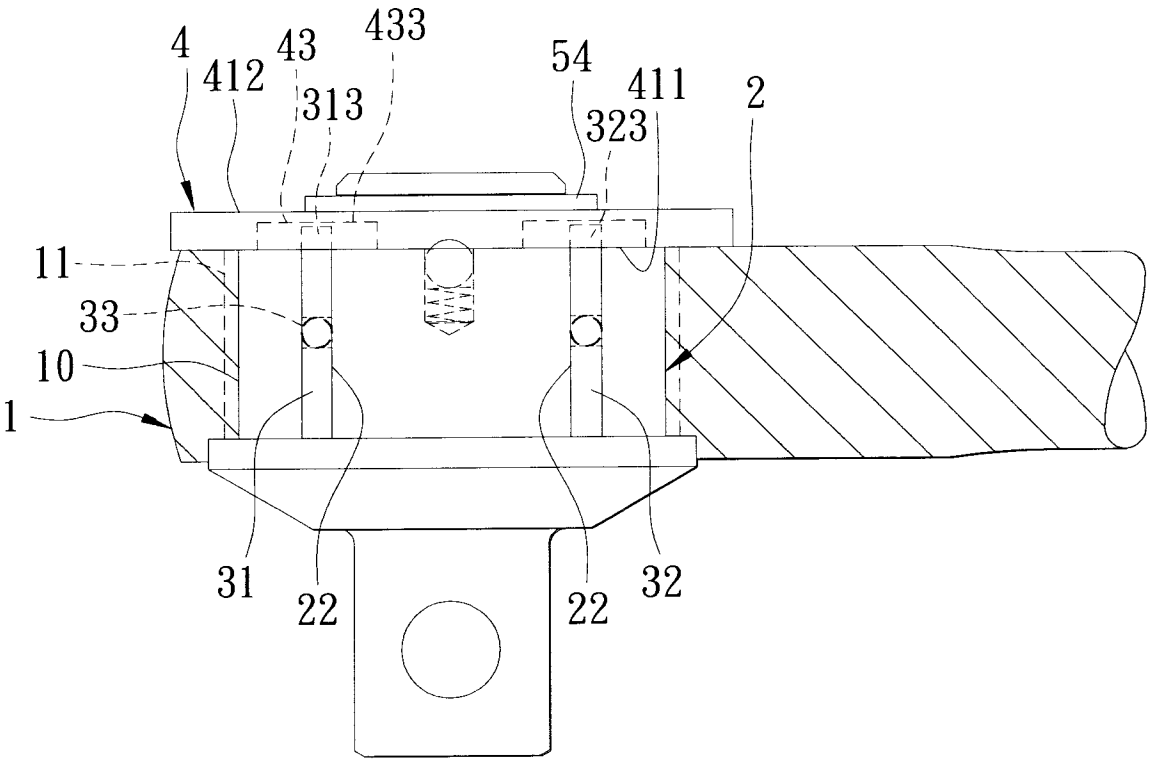
FIG. 10 is a sectional view of the third preferred embodiment of a ratchet tool according to this invention.
Figure 11:
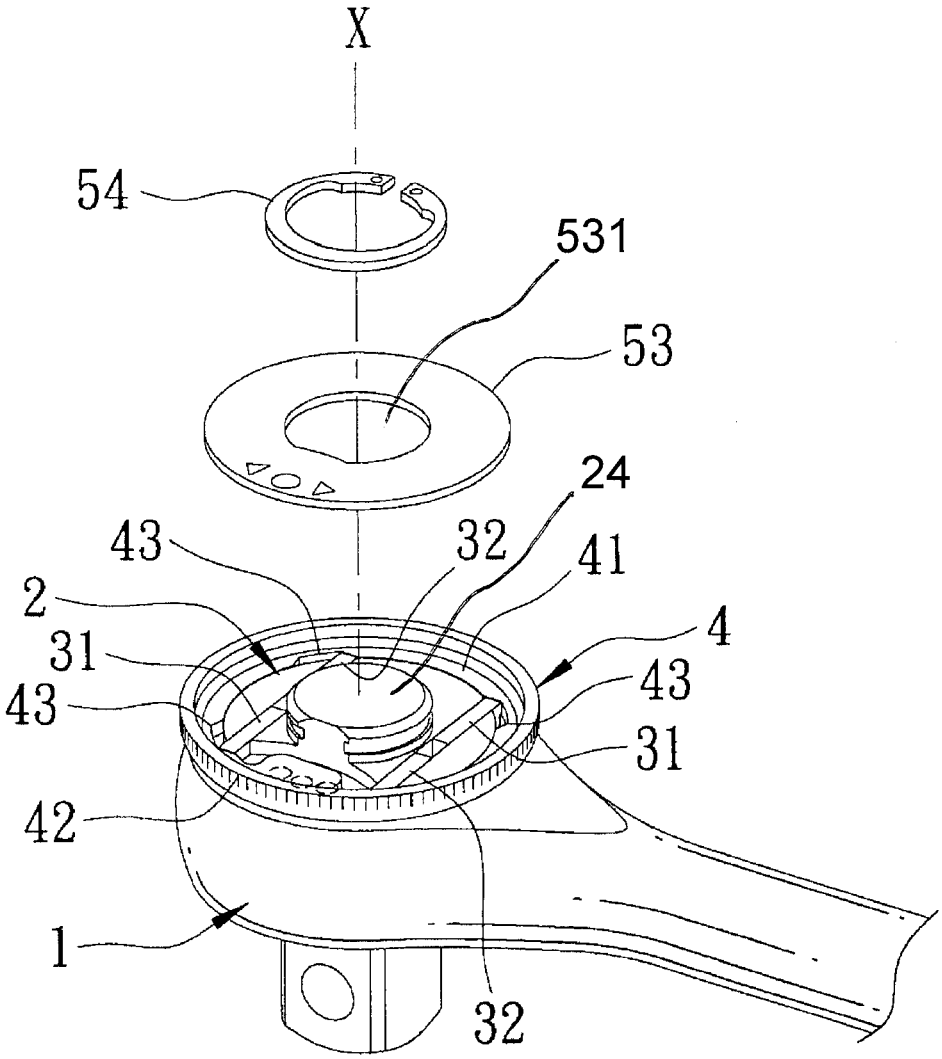
FIG. 11 is an exploded perspective view of the fourth preferred embodiment of a ratchet tool according to this invention.

Referring to FIGS. 10 and 11, the third and fourth preferred embodiments of a ratchet tool according to this invention are similar to the first preferred embodiment. In the third embodiment as shown in FIG. 10, the recessed regions 430 are in the form of recesses formed in the inner major wall surface 411 and have cover surfaces 433 such that a cap 53 can be dispensed with. In the fourth embodiment as shown in FIG. 11, the recessed regions 430 are formed in the rim 42 of the actuator 4.

Figure 12:
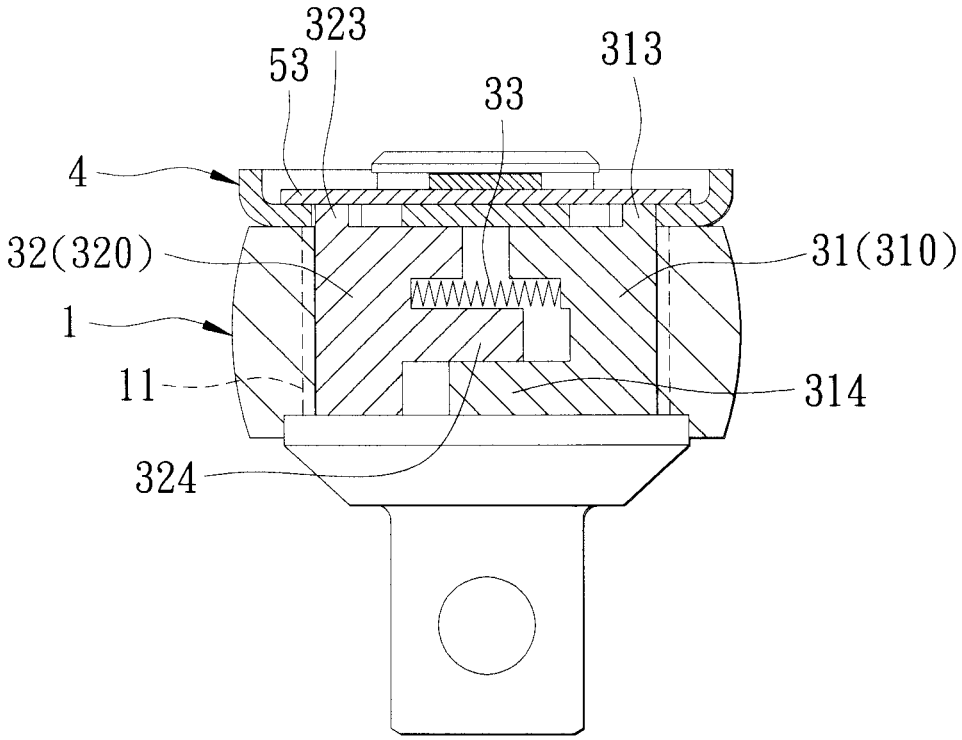
FIG. 12 is a sectional view of the fifth preferred embodiment of a ratchet tool according to this invention.

Referring to FIG. 12, the fifth preferred embodiment of a ratchet tool according to this invention is similar to the first preferred embodiment in construction. In this embodiment, the guided bodies 310, 320 of the first and second pawls 31, 32 (and of the third and fourth pawls 31, 32) respectively have first and second stage portions 314, 324 which extend toward and which are slidably interengaged with each other. In addition, the second stage portion 324 is disposed under the biasing member 33 to permit the biasing member 33 to rest thereon so as to stabilize the biasing action of the biasing member 33. Moreover, the distance between the first and second pawls 31, 32 (and between the third and fourth pawls 31, 32) can be shortened without affecting of the biasing action of the biasing member 33, thereby rendering the ratchet tool more compact.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

What is claimed is:

1. A ratchet tool comprising:

a tool head having an inner peripheral surface which surrounds a rotating axis, and which defines an accommodation space;

a plurality of ratchet teeth disposed on said inner peripheral surface;

a drive body rotatably received in said accommodation space about the rotating axis, and having an outer surrounding surface which surrounds the rotating axis, and which confronts said ratchet teeth, and a body major wall surface facing along the rotating axis, and having a guiding slot which extends through said outer surrounding surface to form two ports thereat, and which is offset from the rotating axis;

first and second pawls, each including a guided body which is fitted in and which is movable relative to said guiding slot, and which extends toward said ratchet teeth to terminate at a pawl end such that said guided body is displaceable between an extending position, where said pawl end extends through a respective one of said ports and is engaged with one of said ratchet teeth, and a retracted position, where said pawl end is retracted in said guiding slot and is disengaged from one of said ratchet teeth, and a key extending from said guided body in a direction of the rotating axis and outwardly of said body major wall surface;

a biasing member disposed to bias said guided bodies toward the extending position; and an actuator disposed to be twistable relative to said tool head about the rotating axis, and having two inner boundary contours which define two recessed regions to respectively accommodate displaceable engagements of said keys with said inner boundary contours, said inner boundary contours being configured such that, when said actuator is twisted by a predetermined degree of angle, a respective one of said keys is displaced between a distal position and a proximate position relative to the rotating axis, thereby bringing said guided body to move between the extending and retracted positions, respectively, wherein said actuator is twistable among a midway position, where said keys are simultaneously displaced to the distal position to move said guided bodies to the extending position so as to prevent rotation of said drive body relative to said tool head, a forward-direction position, where said key of said first pawl is displaced to the distal position to move said guided body of said first pawl to the extending position, and where said key of said second pawl is displaced to the proximate position to move said guided body of said second pawl to the retracted position so as to allow for rotation of said drive body relative to said tool head in a counterclockwise direction, and a backward-direction position, where said key of said first pawl is displaced to the proximate position to move said guided body of said first pawl to the retracted position, and where said key of said second pawl is displaced to the distal position to move said guided body of said second pawl to the extending position so as to allow for rotation of said drive body relative to said tool head in a clockwise direction;

wherein said actuator further has an inner major wall surface which confronts said accommodation space, said inner boundary contours being formed in said inner major wall surface to define said recessed regions, each of said recessed regions having proximate and distal segments which are angularly displaced from each other about the rotating axis to correspond to the proximate and distal positions; and wherein said drive body includes a mounting post extending from said body major wall surface along the rotating axis, said inner major wall surface of said actuator having a central opening to permit said actuator to be sleeved on said mounting post.

2. The ratchet tool according to claim 1, further comprising a releasable retaining unit disposed to retain said actuator to a selected one of the midway, forward-direction and backward-direction positions.

3. The ratchet tool according to claim 2, wherein said body major wall surface has a receiving hole extending in the direction of the rotating axis, said releasable retaining unit including three positioning recesses formed in said inner major wall surface and angularly displaced from one another to correspond to the midway, forward-direction and backward-direction positions, respectively, and a spring-loaded ball received in said receiving hole and urged to engage a selected one of said positioning recesses such that, upon being twisted manually against the biasing force of the spring on said spring-loaded ball, said actuator is displaced to the selected one of the midway, forward-direction and backward-direction positions.

4. The ratchet tool according to claim 3, wherein said actuator further has an outer major wall surface opposite to said inner major wall surface, each of said recessed regions extending through said outer major wall surface in the direction of the rotating axis.

5. The ratchet tool according to claim 1, wherein said biasing member is disposed in said guiding slot between said guided bodies of said first and second pawls.

6. The ratchet tool according to claim 5, wherein said guided bodies of said first and second pawls respectively have first and second stage portions which extend toward and which are slidably interengaged with each other, said second stage portion being disposed under said biasing member to permit said biasing member to rest thereon so as to stabilize the biasing action of said biasing member.

7. The ratchet tool according to claim 5, wherein said body major wall surface has an additional guiding slot disposed in symmetry to said guiding slot relative to the rotating axis, said ratchet tool further comprising third and fourth pawls which are disposed in said additional guiding slot, and which are diametrically opposite to said first and second pawls respectively, and an additional biasing member disposed in said additional guiding slot and between said third and fourth pawls.

8. A ratchet tool comprising:

a tool head having an inner peripheral surface which surrounds a rotating axis, and which defines an accommodation space;

a plurality of ratchet teeth disposed on said inner peripheral surface;

a drive body rotatably received in said accommodation space about the rotating axis, and having an outer surrounding surface which surrounds the rotating axis, and which confronts said ratchet teeth, and a body major wall surface facing along the rotating axis, and having a guiding slot which extends through said outer surrounding surface to form two ports thereat, and which is offset from the rotating axis;

first and second pawls, each including a guided body which is fitted in and which is movable relative to said guiding slot, and which extends toward said ratchet teeth to terminate at a pawl end such that said guided body is displaceable between an extending position, where said pawl end extends through a respective one of said ports and is engaged with one of said ratchet teeth, and a retracted position, where said pawl end is retracted in said guiding slot and is disengaged from one of said ratchet teeth, and a key extending from said guided body in a direction of the rotating axis and outwardly of said body major wall surface;

a biasing member disposed to bias said guided bodies toward the extending position; and an actuator disposed to be twistable relative to said tool head about the rotating axis, and having two inner boundary contours which define two recessed regions to respectively accommodate displaceable engagements of said keys with said inner boundary contours, said inner boundary contours being configured such that, when said actuator is twisted by a predetermined degree of angle, a respective one of said keys is displaced between a distal position and a proximate position relative to the rotating axis, thereby bringing said guided body to move between the extending and retracted positions, respectively, wherein said actuator is twistable among a midway position, where said keys are simultaneously displaced to the distal position to move said guided bodies to the extending position so as to prevent rotation of said drive body relative to said tool head, a forward-direction position, where said key of said first pawl is displaced to the distal position to move said guided body of said first pawl to the extending position, and where said key of said second pawl is displaced to the proximate position to move said guided body of said second pawl to the retracted position so as to allow for rotation of said drive body relative to said tool head in a counterclockwise direction, and a backward-direction position, where said key of said first pawl is displaced to the proximate position to move said guided body of said first pawl to the retracted position, and where said key of said second pawl is displaced to the distal position to move said guided body of said second pawl to the extending position so as to allow for rotation of said drive body relative to said tool head in a clockwise direction, wherein said actuator further has a rim which surrounds the rotating axis, each of said recessed regions formed in said rim, and having proximate and distal segments which are angularly displaced from each other about the rotating axis to correspond to the proximate and distal positions, and wherein said drive body includes a mounting post extending from said body major wall surface along the rotating axis, said ratchet tool further comprising a cap which has a central mounting hole to permit said cap to be mounted on said mounting post, and said cap being configured to cover said accommodation space while permitting said actuator to be twistable relative to said cap.

* * * * *